US006988358B2

(12) United States Patent
Mehail

(10) Patent No.: US 6,988,358 B2
(45) Date of Patent: Jan. 24, 2006

(54) ENGINE HAVING EXTERNAL COMBUSTION CHAMBER

(75) Inventor: James J. Mehail, Milwaukee, WI (US)

(73) Assignee: Jeffrey S. Melcher, Bethesda, MD (US)

( * ) Notice: Subject to any disclaimer, the term of this patent is extended or adjusted under 35 U.S.C. 154(b) by 0 days.

(21) Appl. No.: 10/791,698

(22) Filed: Mar. 4, 2004

(65) Prior Publication Data

US 2004/0163376 A1 Aug. 26, 2004

Related U.S. Application Data

(60) Division of application No. 10/282,010, filed on Oct. 29, 2002, now Pat. No. 6,718,751, which is a continuation-in-part of application No. 10/119,041, filed on Apr. 10, 2002, now Pat. No. 6,490,854, which is a division of application No. 09/986,963, filed on Nov. 13, 2001, now Pat. No. 6,418,708, which is a division of application No. 09/680,468, filed on Oct. 6, 2000, now Pat. No. 6,334,300.

(60) Provisional application No. 60/158,137, filed on Oct. 8, 1999.

(51) Int. Cl.
*F02G 1/02* (2006.01)

(52) U.S. Cl. ..... 60/39.6

(58) Field of Classification Search ..... 60/39.6, 60/39.62, 39.63
See application file for complete search history.

(56) References Cited

U.S. PATENT DOCUMENTS

| | | | |
|---|---|---|---|
| 1,510,688 | A | 10/1924 | La Fon |
| 1,831,976 | A | 11/1931 | Stow |
| 1,847,260 | A | 3/1932 | Pardee |
| 1,849,347 | A | 3/1932 | Dale |
| 1,884,077 | A | 10/1932 | Michlun |
| 2,432,177 | A | 12/1947 | Sedille |
| 2,688,230 | A | 9/1954 | Milliken |
| 3,517,970 | A | 6/1970 | Cripe |
| 3,704,760 | A | 12/1972 | Maruyama |
| 3,765,180 | A | 10/1973 | Brown |
| 3,867,812 | A | 2/1975 | Van Arsdel |
| 3,881,399 | A | 5/1975 | Sagi et al. |
| 3,885,387 | A | 5/1975 | Simington |
| 3,896,775 | A | 7/1975 | Melby |
| 3,913,699 | A | 10/1975 | Dyer |
| 3,925,984 | A | 12/1975 | Holleyman |
| 3,980,152 | A | 9/1976 | Manor |
| 4,018,050 | A | 4/1977 | Murphy |
| 4,079,586 | A | 3/1978 | Kincaid, Jr. |
| 4,102,130 | A | 7/1978 | Stricklin |
| 4,114,575 | A | 9/1978 | Nohira et al. |
| 4,124,978 | A | 11/1978 | Wagner |
| 4,149,618 | A | 4/1979 | Horie |
| 4,162,614 | A | 7/1979 | Holleyman |

(Continued)

FOREIGN PATENT DOCUMENTS

DE 197483 4/1907

(Continued)

*Primary Examiner*—Michael Koczo, Jr.
(74) *Attorney, Agent, or Firm*—Jeffrey S. Melcher; Manelli Denison & Selter, PLLC

(57) ABSTRACT

Provided is an engine having positive displacement chambers containing pistons and an external combustion chamber which utilizes the compression energy in compressed natural gas from a high pressure main line and compressed air in combination with the energy released during combustion of the fuel to drive the pistons. Energy expended compressing the natural gas and air are recovered. Also provided is an electrical generator driven by the engine.

10 Claims, 10 Drawing Sheets

U.S. PATENT DOCUMENTS

| | | | | |
|---|---|---|---|---|
| 4,219,738 | A | 8/1980 | Griesinger | |
| 4,292,804 | A | 10/1981 | Rogers, Sr. | |
| 4,311,917 | A | 1/1982 | Hencey, Jr. et al. | |
| 4,337,842 | A | 7/1982 | Spangler et al. | |
| 4,354,464 | A | 10/1982 | Fujita | |
| 4,355,508 | A | 10/1982 | Blenke et al. | |
| 4,369,623 | A | 1/1983 | Johnson | |
| 4,370,857 | A | 2/1983 | Miller | |
| 4,383,589 | A | 5/1983 | Fox | |
| 4,404,800 | A | 9/1983 | Penney | |
| 4,426,986 | A | 1/1984 | Muller et al. | |
| 4,478,304 | A | 10/1984 | Delano | |
| 4,507,918 | A | 4/1985 | Holleyman | |
| 4,557,233 | A | 12/1985 | Joppig et al. | |
| 4,596,119 | A | 6/1986 | Johnson | |
| 4,616,476 | A | 10/1986 | Oneyama et al. | |
| 4,651,525 | A | 3/1987 | Cestero | |
| 4,669,435 | A | 6/1987 | Furusawa et al. | |
| 4,694,653 | A | 9/1987 | Kawamura | |
| 4,696,158 | A | 9/1987 | DeFrancisco | |
| 4,769,988 | A | 9/1988 | Clark, Jr. | |
| 4,774,891 | A | 10/1988 | Coester | |
| 4,864,151 | A | 9/1989 | Wyczalek et al. | |
| 4,896,505 | A | 1/1990 | Holleyman | |
| 4,947,731 | A | 8/1990 | Johnston | |
| 5,115,145 | A | 5/1992 | Westberg et al. | |
| 5,163,292 | A | 11/1992 | Holleyman | |
| 5,326,229 | A | 7/1994 | Collins | |
| 5,515,675 | A | 5/1996 | Bindschatel | |
| 5,680,764 | A | 10/1997 | Viteri | |
| 5,806,403 | A | 9/1998 | Johnston | |
| 5,860,407 | A | 1/1999 | Chapin | |
| 5,915,619 | A | 6/1999 | Etheve | |
| 6,092,365 | A | 7/2000 | Leidel | |
| 6,334,300 | B1 * | 1/2002 | Mehail | 60/39.6 |
| 6,490,854 | B2 * | 12/2002 | Mehail | 60/39.6 |
| 6,530,211 | B2 | 3/2003 | Holtzapple | |

FOREIGN PATENT DOCUMENTS

| | | |
|---|---|---|
| DE | 663976 | 7/1938 |
| DE | 1040839 | 10/1958 |
| EP | 141634 | 5/1985 |
| EP | 0159146 | 10/1985 |
| JP | 58-28414 | 2/1983 |
| JP | 59-141712 | 8/1984 |
| JP | 158364 | 9/1984 |

* cited by examiner

ENGINE HAVING EXTERNAL COMBUSTION CHAMBER

This application is a divisional of U.S. Ser. No. 10/282,010, filed Oct. 29, 2002, which is a Continuation-in-Part of U.S. Ser. No. 10/119,041, filed on Apr. 10, 2002, now U.S. Pat. No. 6,490,854, which is a divisional of U.S. Ser. No. 09/986,963, filed Nov. 13, 2001, now U.S. Pat. No. 6,418,708, which claims priority to U.S. Ser. No. 09/680,468, filed on Oct. 6, 2000, now U.S. Pat. No. 6,334,300, which claims priority to U.S. Ser. No. 60/158,137, filed on Oct. 8, 1999, now abandoned, the complete disclosures of which are incorporated herein by reference.

FIELD OF THE INVENTION

The invention relates to an engine having positive displacement chambers and an external combustion chamber, which utilizes the compression energy stored in a compressed natural gas main and compressed air in combination with the energy released during combustion of the fuel, to drive an electrical generator. Energy expended compressing the natural gas and air to high-pressures at an external source is recovered and utilized in combination with combustion of the fuel in an external combustion chamber to selectively power the engine on demand.

BACKGROUND OF THE INVENTION

Internal combustion engines provide both portable and stationary power sources that have materially enhanced the development of industry throughout the world. It is well known that internal combustion engines are relatively inefficient and make use of only a portion of the available energy that may be derived from fossil fuels and other fuels available. In recent years, especially in view of the increasing costs of fuels, government regulation, as well as environmentalism, most engine manufacturers have undertaken the development of more efficient and environmentally friendly engine systems. Such developments have been in the nature of improving specific characteristics of internal combustion engines such as fuel metering, carburetor, fuel injection, valve control, fuel ignition, and the like. Although many positive results have been achieved toward fuel economy the cost of fuel to the consumer, as well as emissions to the environment, represent a disadvantage to the practical utilization of internal combustion engines. It is desirable to design and provide an engine energy-producing system that minimizes utilization of various types of fuels, along with emissions, and yet provides an engine system having an energy and power output that may be utilized at or above the current efficiency of the energy and power output of conventional internal combustion engines.

Air pollution (emissions) is an ordinary byproduct of conventional internal combustion engines, which are used in most motor vehicles today. Various devices, including items mandated by legislation, have been proposed in an attempt to limit the emissions, which a conventional internal combustion engine exhausts to the atmosphere. Most of these devices have met with limited success and are often prohibitively expensive as well as complex. A cleaner more efficient alternative to the conventional internal combustion engine is needed to power vehicles and other machinery.

A compressed gas could provide a motive energy source for an engine since it could eliminate most of the usual pollutants exhausted from an internal combustion engine burning gasoline. An apparatus for converting an internal combustion engine for operation on compressed air is disclosed in U.S. Pat. No. 3,885,387 issued May 27, 1975 to Simington. The Simington patent discloses an apparatus including a source of compressed air and a rotating valve actuator, which opens and closes numerous mechanical poppet valves. The valves deliver compressed air in a timed sequence to the cylinders of an engine through adapters located in the spark plug holes. The output speed of an engine of this type is limited by the speed of the mechanical valves and in fact the length of time over which each of the valves remains open cannot be varied as the speed of the engine varies.

Another apparatus for converting an internal combustion engine for operation on steam or compressed air is disclosed in U.S. Pat. No. 4,102,130 issued Jul. 25, 1978 to Stricklin. The Stricklin patent discloses a device, which changes the valve timing of a conventional four (4)-stroke engine so that the intake and exhaust valves open once for every revolution of the engine instead of once every other revolution of the camshaft in a four (4) stroke engine. A reversing valve is provided which delivers live steam or compressed air to the intake valves and is subsequently placed in the reversed position in order to allow the exhaust valves to deliver the expanded steam or air to the atmosphere. A reversing valve of this type does not provide a reliable apparatus for varying the amount of motive fluid (gas) to be injected into the cylinders when it is desired to increase the speed of the engine. A device of the type disclosed in the Stricklin patent also requires the use of multiple reversing valves if the cylinders in a multi-cylinder engine are to be fired in a sequential fashion.

Engines having an adiabatic structure have recently come into productive use. These engines employ an adiabatic material such as a ceramic for constructing engine components including the combustion chambers and exhaust pipe. Engines of this type do not require the cooling of the engine by dissipating the internally generated heat. The heat energy possessed by the high-temperature exhaust gas, produced by the conventional combustion engine, is recovered and fed back to the engine output shaft, axles and the like to enhance engine output.

One known method of recovering exhaust gas energy is to reduce the rotational force of a turbine. This turbine is rotated by the exhaust gas using a multi-stage gear mechanism to drive the engine crankshaft. Another method of energy recovery is to effect a series connection between an exhaust turbine having a compressor for intake, and supply the output of the attached generator to a motor provided on the engine output shaft, thereby enabling the exhaust energy to be recovered for rotational energy use. Still another idea is to provide the engine with an exhaust bypass circuit; effect the series connection between the exhaust turbine having the generator and the exhaust turbine having the compressor to intake; supply the output of the generator to a motor provided on the engine output shaft; drive the compressor; and control the amount of exhaust that passes through the exhaust bypass circuit, thus running the engine in a nearly ideal state. These proposals have been disclosed in the specification of Japanese Patent Application Laid-Open (Kokai) No. 59-141712, which describes an engine equipped with an exhaust energy recovery apparatus. This is also elaborate and impracticable. However, the gear mechanisms required for these methods introduces design-specific problems. The transfer efficiency of one stage of a gear mechanism ordinarily is 90–95% and there is a decline in efficiency to about 80% with a three-stage gear mechanism. Furthermore, the nominal rotational speed of an exhaust gas turbine can be as high as 10,000 rpm. Reducing the turbine speed requires a gear mechanism having a greater number of stages, thus resulting in much lower transfer efficiency and a greater amount of frictional loss usually with accompanying increase in assembly weight. Since the rotational speed of the exhaust gas turbine is manufactured to accommodate the rotational speed of the engine, optimum engine turbine performance cannot be achieved.

With proposals described in Japanese Patent Application Laid-Open (Kokai) No. 59-141712, the engine is run in an almost ideal state by controlling the amount of exhaust gas flowing through the exhaust bypass circuit on the basis of data received from an engine velocity sensor and an engine load sensor. No control is performed to optimize the rotational speed of the exhaust turbine or the efficiency of the turbine.

An exhaust brake control system installed in an automotive vehicle equipped with an automatic or possible manual transmission is not new to the industry. The specification of Japanese patent Kokoki Publication No.58-28414 describes an exhaust brake control system in which an exhaust brake is controlled by signals from an exhaust brake switch usually placed on the vehicle instrument panel, a throttle switch actuated based upon the amount the vehicle accelerator pedal is depressed, and a shift switch actuated by manual control of the automatic transmission. Compressed air generated during brake actuation may be stored in an accumulator for subsequent use during periods of peak power demand or even when the engine is cold.

U.S. Pat. No. 4,369,623 describes a positive displacement engine having an external combustion chamber. Solid, liquid and gaseous fuels can be burned in the external combustion chamber. This type of engine requires a fuel pump 36 which pumps the liquid or gaseous fuel to the combustion chamber (column 2, lines 49–51). This patent does not teach the use of a high-pressure fuel vessel nor the use of a high-pressure air vessel, which are capable of containing at least about 1,000 pounds per square inch (psi). Positive displacement cylinders of automobiles, such as those described in the '623 patent are only capable of pumping air up to a maximum of about 140 psi (based on atmospheric pressure of 14 psi and a 10:1 compression ratio). This patent also does not teach or suggest utilizing the significant energy stored in compressed fuel and compressed air from an source external to the engine in combination with the energy released during combustion of the fuel in order to further reduce the amount of fuel combusted and reduce the emission produced.

There is a need for an improved combustion engine that utilizes the energy expended compressing the fuel and air to high-pressures at an external source, such as a gas station or residence, in combination with combustion of the fuel in an external combustion chamber to selectively power the engine on demand to avoid producing emissions and wasting fuel during idle at stops.

SUMMARY OF THE INVENTION

An objective of the present invention is to provide an improved combustion engine that utilizes the energy stored in compressed natural gas of a high pressure main and compressed air in combination with the energy released during combustion of the fuel to power an engine.

Another objective of the present invention is to provide an improved combustion engine having reduced emissions.

A further objective of the present invention is to provide an engine having instant-on power such that the an electrical generator powered by the engine can easily be shut down or operated at reduced power levels when electrical demand is low or non-existent.

The above objectives and other objectives are obtained by a combustion engine comprising:

at least one positive displacement chamber;

a reciprocating piston disposed in said at least one positive displacement chamber;

an external combustion chamber in communication with the positive displacement chamber for containing a mixture of compressed gas;

an ignitor in the combustion chamber constructed and arranged to ignite a fuel in the combustion chamber;

at least one valve constructed and arranged to control the flow of the compressed gas from the combustion chamber into the positive displacement chamber;

at least one exhaust valve constructed and arranged to control the flow of expanded gas from the positive displacement chamber;

a high pressure main connector for connecting a high pressure natural gas main line to the combustion chamber constructed;

a high pressure main valve in communication with the high pressure main connector and combustion chamber for controlling the flow of natural gas from the high pressure natural gas main line to the combustion chamber;

a high-pressure air vessel in communication with the combustion chamber;

at least one valve for controlling the flow of pressurized air from the high-pressure air vessel to the combustion chamber; and at least one external valve constructed and arranged to fill the high-pressure air vessel with compressed air from an external pressurized air source.

Also provided is a fast response time electrical generator that utilizes the compression energy in compressed natural gas from a high pressure main line comprising:

a generator having an electric output connector; and an engine connected to the generator, wherein the engine comprises;

at least one positive displacement chamber;

a reciprocating piston disposed in said at least one positive displacement chamber;

an external combustion chamber in communication with the positive displacement chamber for containing a mixture of compressed gas;

an ignitor in the combustion chamber constructed and arranged to ignite a fuel in the combustion chamber;

at least one valve constructed and arranged to control the flow of the compressed gas from the combustion chamber into the positive displacement chamber;

at least one exhaust valve constructed and arranged to control the flow of expanded gas from the positive displacement chamber;

a high pressure main connector for connecting a high pressure natural gas main line to the combustion chamber constructed;

a high pressure main valve in communication with the high pressure main connector and combustion chamber for controlling the flow of natural gas from the high pressure natural gas main line to the combustion chamber;

a high-pressure air vessel in communication with the combustion chamber;

at least one valve for controlling the flow of pressurized air from the high-pressure air vessel to the combustion chamber; and at least one external valve constructed and arranged to fill the high-pressure air vessel with compressed air from an external pressurized air source.

The invention further provides a method of making electricity and recovering the compression energy in an engine comprising:

supplying compressed natural gas from a high pressure main line to a combustion chamber;

supplying compressed air from a high pressure air vessel to the combustion chamber from the high-pressure air vessel;

burning said fuel and air in said combustion chamber to form a compressed combustion gas;

opening an intake valve and supplying said compressed combustion gas to a positive displacement chamber containing a reciprocating piston such that said compressed combustion gas expands forcing said piston in a direction that increases the volume of the positive displacement cylinder to form an expanded gas;

closing said intake valve and opening an exhaust valve and allowing the expanded gas to exit said displacement chamber while said piston is moving in a direction which decreases the volume of the positive displacement chamber to provide a exhaust gas and thereby produce rotational energy; and driving an electrical generator with said rotational energy to produce electricity.

The present invention has an advantage over prior art engines in that the significant compression energy of compressed natural gas in a high pressure main and compressed air is utilized in combination with the energy released during combustion of the natural gas to power an engine. The significant energy expended during compression of the natural gas and air can be recovered during use of the engine, such as the production of electricity.

Another advantage of the present invention is that it provides instant-on power, such that combustion can be shut down during non-use, as well as operation at reduced power levels.

DETAILED DESCRIPTION OF PREFERRED EMBODIMENTS

Figure 1:
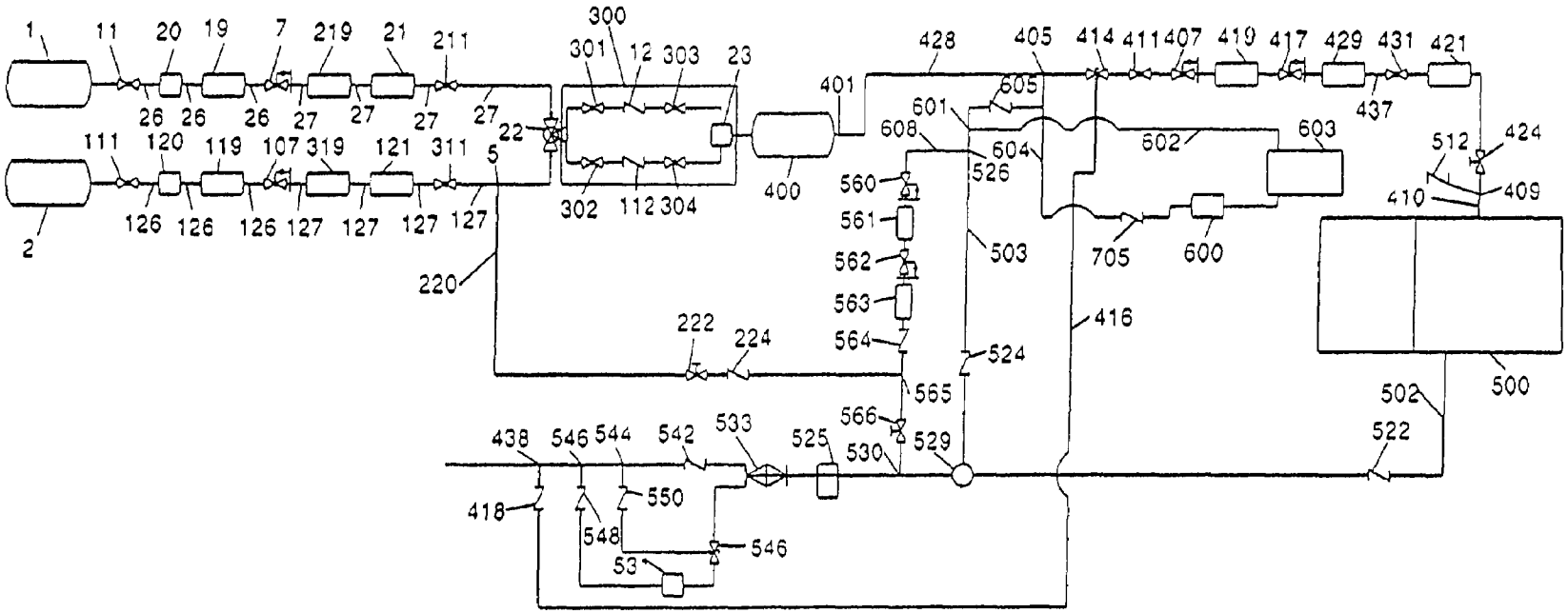
FIG. 1 illustrates a process and mechanical schematic diagram view illustrating a two-vessel embodiment of the present invention.

The engine of the present invention is thermodynamically similar to the Brayton or Joule cycle, while also resembling the Otto cycle in that it utilizes one or more pistons or other positive displacement devices for power generation. The present invention is also similar to Carnot Cycle sans compression stroke and to the Rankine Cycle sans the condenser and feed pump. Fuel combustion is external of the positive displacement chambers, which provides many advantages. The use of a combustion chamber separated from the positive displacement chambers presents different property criteria in the form of fuel employed, only pressurized gaseous fuel may be utilized. The combustion temperature may be lower than conventional engines and the combustion time longer, resulting in more complete combustion, which leads to substantially reducing the level of pollutants (emissions) in the exhaust. Another positive result is that no critical ignition timing is necessary in this design assembly.

The present invention applies a process which is a combination adiabatic (no heat crosses boundary), isentropic (reversible) and throttling (significant pressure drop with a constant temperature) intended to be applied in an engine. The engine comprises integrated devices and apparatus that converts energy into mechanical motion, and can be adapted to recover kinetic, heat and pressure energy for subsequent use.

The engine of the invention may be employed in a wide variety of applications tailored to the specific needs as desired. When used to power a vehicle such as an automobile, the engine of the invention will provide increased efficiency, reduced exhaust levels, faster starting capability, compressed gas availability, dynamic braking, and power on demand availability. For vehicles that make numerous starts and stops, especially larger vehicles like buses and trucks, the savings of kinetic and thermal braking energy would be significant. The engine may also find application in other power plants used in such vehicles like locomotives, farm tractors, marine engines, airplanes and the like. Use as a stationary power plant is also applicable to this design and would include electrical generator sets for example. A primary advantage of use in an airplane, utilizing the present engine would be high horsepower availability for the size and corresponding weight of the engine during take-off because of the availability of the compressed gas for maximum torque (high power to low weight ratio).

The present invention relates to positive displacement engines having a novel and original engine hybrid design. The combustion chamber is separated from the positive displacement piston chambers which receive compressed gases from the combustion chamber for an automotive vehicle equipped with an automatic or manual transmission as an example. The engine can be easily adapted for recovering energy contained in linear and rotational kinetic motion of the automobile and engine respectively. Energy recovery can also be achieved by operating an exhaust turbine having a generator, thereby improving the exhaust energy recovery efficiency as well as an energy recovery apparatus for operating an exhaust gas redirecting valve for compressed gas energy recovery and storage.

In a preferred embodiment of the present invention, the valve for admitting compressed gas to the engine is manually (mechanically) actuated, such as by the now well-known "gas pedal." For example, on conventional gasoline powered engines, the carburetor, fuel systems and ignition systems can be remove and the compressed gas directly fed into the intake manifold and conventional intake valves.

Other features and advantages of the present invention will be apparent from the following description of preferred embodiments taken in conjunction with the accompanying non-limiting drawings, in which like reference characters designate the same or similar parts throughout the figures thereof.

Double High-Pressure Vessel Embodiment

FIG. 1 is a schematic view illustrating a two-vessel embodiment of a combustion engine and energy recovery apparatus based on the present invention. This configuration for operation of the engine employs a high-pressure fuel vessel and a high-pressure air vessel. The high-pressure vessels should be capable of containing pressures greater than 1,000 psi, preferably greater than 2,000 psi, more preferably greater than 3,000 psi, and most preferably greater at least about 3,500 psi. These high-pressure vessels can be filament wound composite and aluminum, purely composite filament or the like. The compressed air and fuel vessels can be sized according to the fuel selected. If natural gas (methane) is utilized, the compressed air vessel should be about 5 times greater in volume than the fuel vessel, if both vessels are to be filled to substantially the same pressure. Any compressed gas fuel can be utilized as desired, such as methane, propane, butane, hydrogen, and the like. However, compressed natural gas "CNG" is the preferred fuel and will be used as an example in the preferred embodiments and attached Figs. One skilled in the art will easily be able to provide the proper size vessels to provide sufficient air/fuel ratios for the desired application.

The high-pressure fuel and air vessels are provided with respective fill/pressure taps 20 and 120 such that they can be filled by a source external to the engine 500, such as a gas station, residence, workplace, or any other location. The significant energy expended during compression of the fuel and air at the users residence, work, gas station, or other, can be recovered during use of the vehicle. In this manner, fuel, such as natural gas, and air can be compressed during night hours when electricity rates are low and the energy expended compressing the fuel and air recovered during use of the engine, in order to further reduce the amount of fuel combusted and reduce the emission produced.

Figure 2:
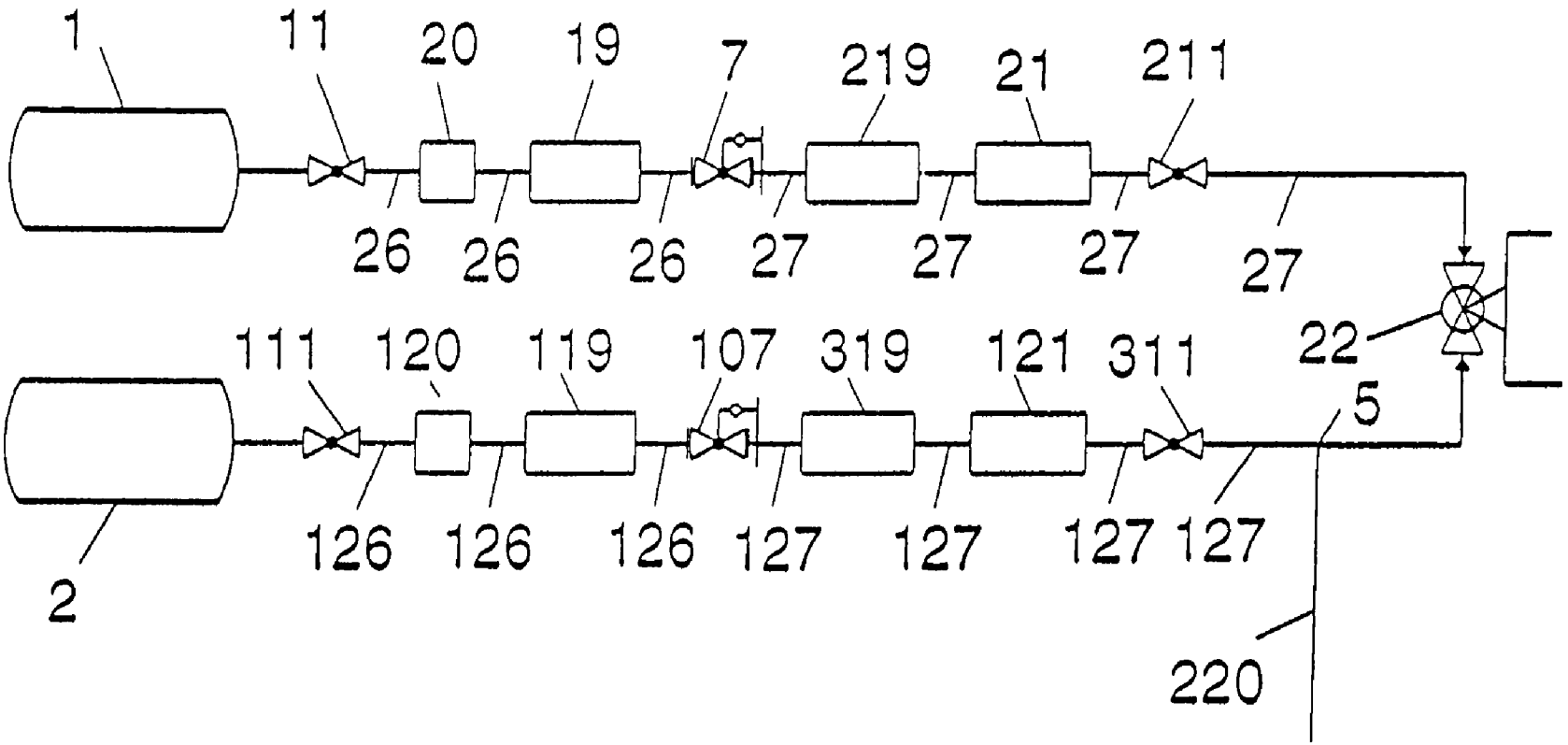
FIG. 2 illustrates a sectional process and mechanical schematic diagram view of FIG. 1 showing the fuel (compressed natural gas) and air high-pressure vessels with associated supply piping (tubing) as well as associated apparatus flowing to the fuel/air mixing section along with the air emergency bypass.
Figure 3:
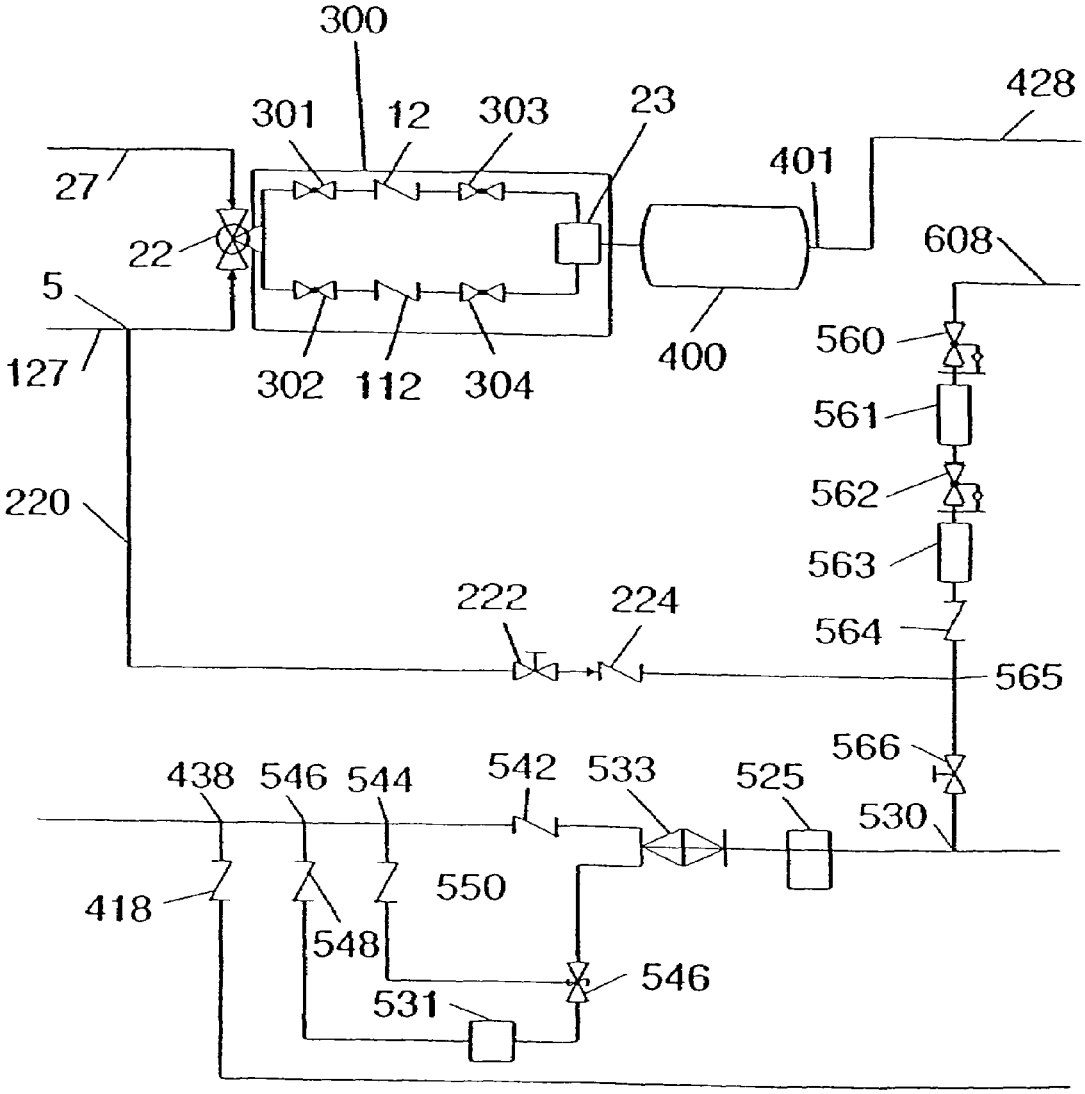
FIG. 3 illustrates a sectional process and mechanical schematic diagram view pf FIG. 1 showing the ignition assembly, combustion/storage chamber, auxiliary exhaust piping (tubing), emergency air bypass and exhaust piping (tubing) assembly.

In FIG. 1, an engine having an adiabatic/isentropic and throttling characteristic is displayed. In FIG. 2 the CNG and compressed air supply flow from respective high-pressure CNG vessel 1 and high-pressure air vessel 2 through respective globe valves 11 and 111, high-pressure piping (tubing) 26 and 126, fill/pressure taps 20 and 120, pressure/sensor gauges 19 and 119, and are partially depressurized, to a desired operating pressure by concentric pressure regulators/reducers 7 and 107. The compressed gasses continue flowing through respective low/medium pressure gas piping (tubing) 27 and 127, pressure/sensor gauges 219 and 319, flow meters 21 and 121, globe valves 211 and 311 to independent (mutually exclusive) paths to a fuel/air mixture proportional control valve 22 which is in communication with a combination combustion, expansion, storage accumulator, reservoir, heat exchanger and gas pressure generation vessel 400, hereinafter referred to as a combustion chamber 400. The low/medium pressure gas piping 127 is fitted with a tee 5. In FIG. 3 the flow continues through the ignition assembly 300. The compressed gasses flow from the fuel/air mixture proportion control valve 22 to respective globe valves 301 and 302, check valves 12 and 112, and globe valves 303 and 304, concluding at an electro static exciter/spark magneto (capacitive discharge) 23 or auto-ignition continuous and intermittent (interrupted) ignition assembly 23 feeding the combustion chamber 400 which are ignited in place. Any desired operating pressure in the combustion chamber 400 can be utilized for the particular application. For example, higher operating pressures can be utilized to provide a higher torque output when desired, compared to lower pressures for lower torque outputs. Preferred operating pressures are from about 100 to about 400 psi, more preferably from about 150 to about 300 psi, and most preferably from about 200 to about 250 psi. The combustion pressure vessel has much greater volume than the engine's positive displacement chambers (also commonly referred to as engine cylinders).

As shown in FIG. 2, the compressed supply air can be used to provide emergency-type electricity by flowing from the air supply cylinder through a globe valve 111, high-pressure piping (tubing) 126, a fill/pressure tap 120, pressure/sensor gauge 119, is partially depressurized, by pressure regulator 107, flowing through low/medium pressure gas piping (tubing) 127, a pressure/sensor gauge 319, flow meter 121 and globe valve 311, prior to flowing though the emergency piping (tubing) assembly branched off the main flow path by tee 5 and piping 220. This branch feeds a single compressed air-only ingress to the exhaust portion of the system including the turbo-electric generator and the heat exchanger as follows: the branched feed flows from the tee 5 through low/medium pressure piping (tubing) 220, throttle valve 224 and check valve 224 to the exhaust (combustion gas) piping (tubing) portion of the system.

Figure 4:
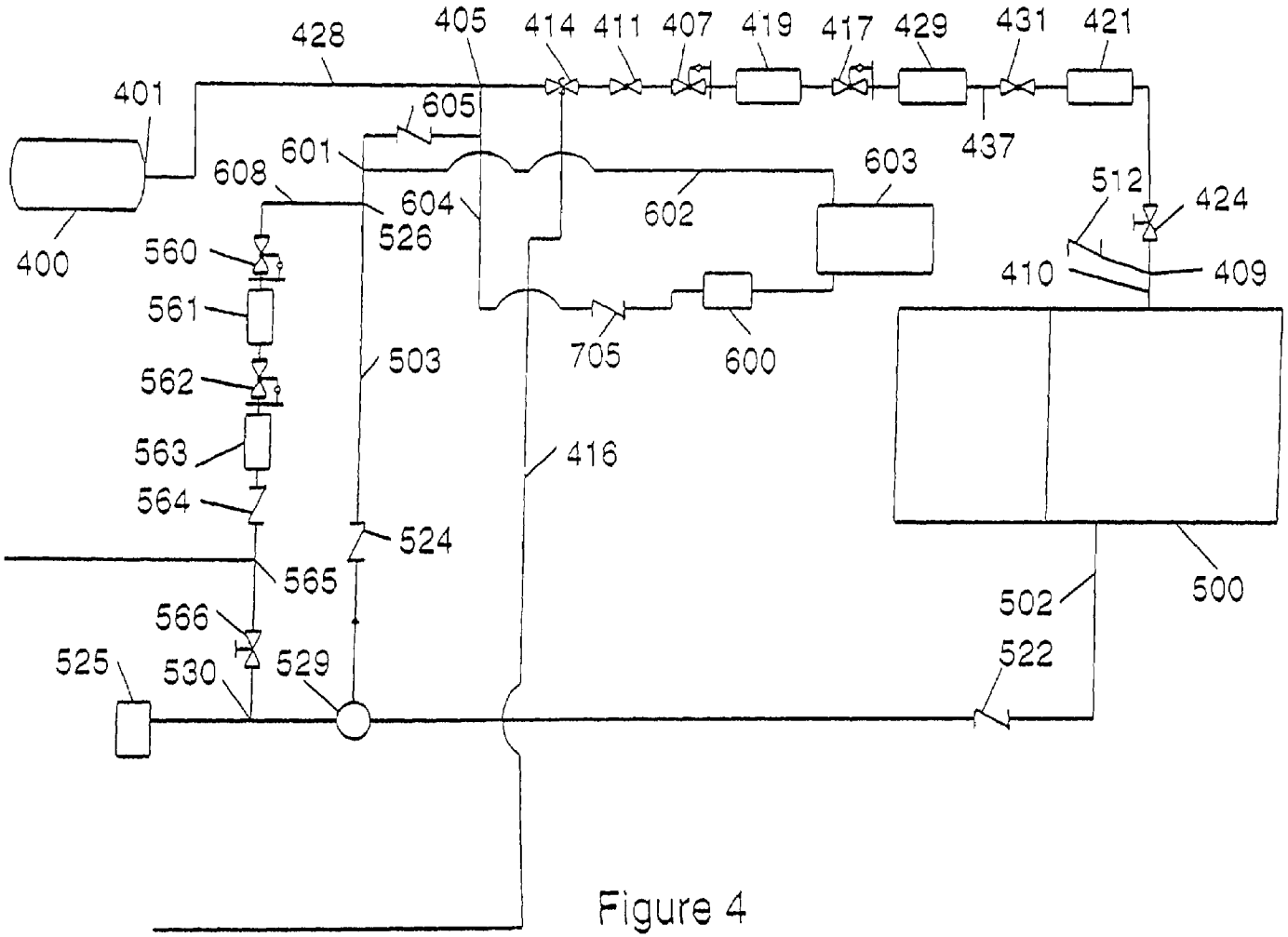
FIG. 4 illustrates a sectional process and mechanical schematic diagram view of FIG. 1 showing the auxiliary bypass piping (tubing), regenerative brake piping (tubing) and main engine/motor compressor pump assembly.

Referring to FIG. 4, the high-pressure combustion gas/piping (tubing) 428 (expanded and stored), primarily flows to, via combustion gas distributor piping 428, a hybrid (integrated) engine 500. The combustion chamber outlet 401 flows into the combustion gas piping (tubing) 428 through a tee fitting 405, safety valve 414, globe valve 411, concentric regulator/reducer 407, pressure sensor/gauge 419, concentric regulator/reducer 417, pressure sensor/gauge 429, globe valve 431, flow meter 421, main engine throttle valve 424, lateral 409, and pipe 410 to the inlet manifold of the main engine 500 assembly. An ambient air vacuum break check valve 512 is connected to the lateral 409, which allows ambient air to enter the positive displacement chamber 551 during regenerative braking.

Figure 9:
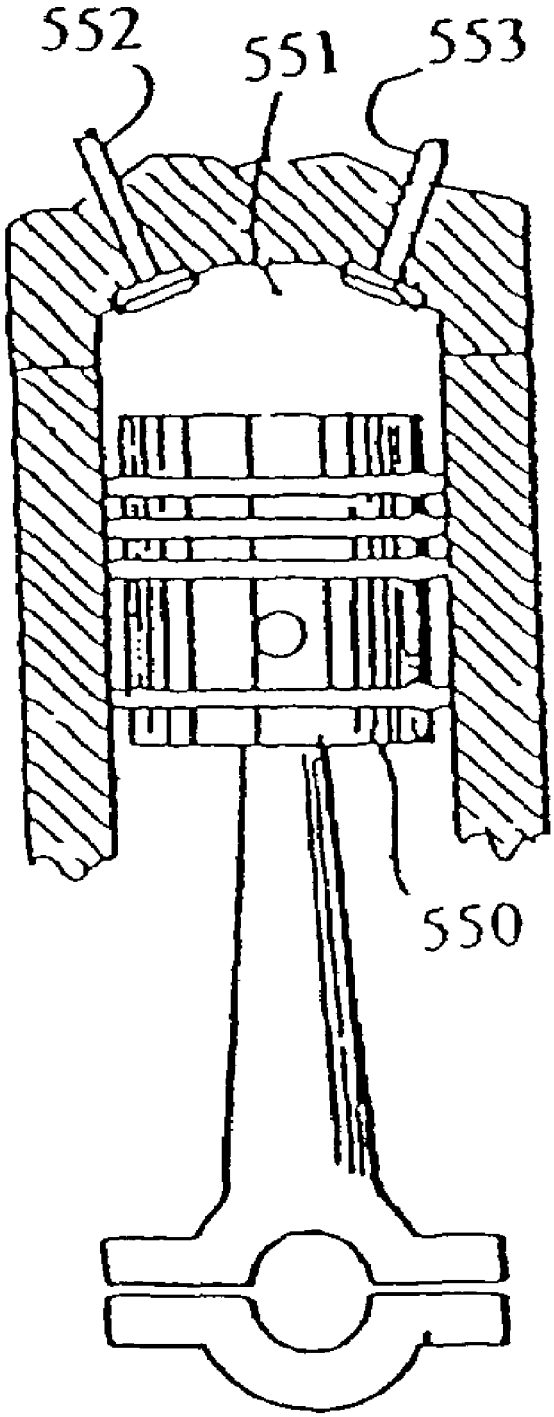
FIG. 9 illustrates a positive displacement chamber in the engine.

The engine 500 is a pneumatic pressure compressed gas (pressurized) double-acting engine (motor)/compressor and pneumatic mechanical brake (pump). As shown in FIG. 9, the engine 500 has at least one two-stroke reciprocating positive displacement free piston 550 disposed in a positive displacement chamber 551, at least one intake valve 552 for controlling the flow of pressurized gas into the positive displacement chamber 551 and at least one exhaust valve 553 for controlling the flow of expanded gas from the positive displacement chamber. The pressurized gas flows though the pipe 409 into the intake manifold and through the open intake valve 552. The expanded gas is exhausted from positive displacement chamber 551 through open exhaust valve 553 and into exhaust pipe 502. If desired, conventional four-stroke internal combustion engines can be modified to two-stroke by modifying the cam system to turn one-to-one with the crank shaft instead of the common two-to-one ratio. Instead of changing the ratio between the cam and crank, lobes can be added to the cam so that the valves are opened on each revolution of the crank and twice for each revolution of the cam. Example of such modifications are now well known and described in U.S. Pat. No. 4,102,130, which is incorporated herein by reference.

The high-pressure combustion gas can also be used utilized from a pressure tap fitting 437 located just after the regular concentric reducer 407 for use by pneumatic tools, an impact wrench for example, or any other pressurized gas application.

Power output of the engine 500 is primarily in the form of mechanical rotational variable torque transmission controlled by a pneumatic or mechanical throttle valve 424 resulting in, and measured as, RPM of the engine/motor compressor pump. The valve throttle valve 424 can be actuated in a conventional manner, such as by the now well-known gas peddle. The piston 550 area and throw are designed to allow expansion to a near ambient pressure in the positive displacement chamber 551, thus reducing initial engine exhaust pressures to essentially atmospheric. With reference to FIG. 9, an engine intake valve 552 is provided to selectively admit compressed gas supplied from pipe 410 to the positive displacement chamber 551 when the piston 550 is at a desired position, such as about top dead center position. The timing of the opening of the intake valve 552 can be advanced such that the compressed gas is admitted to the positive displacement chamber 551 progressively further before the top dead center position of the piston 550 as the speed of the engine increases. Once the compressed gas enters the positive displacement chamber 551, it expands forcing the piston 550 in a direction which increases the volume in the positive displacement chamber 551 to form an expanded gas. The expanded gas is exhausted from the positive displacement chamber 551 through an exhaust valve 553 and into pipe 502, while the piston 550 is moving in a direction which decreases the volume in the positive displacement chamber 551. The present invention allows for the variable adjustment of the intake and exhaust valves for operation utilizing compressed combustion gas and the compression of gas (including air from the vacuum break check valve 512). The engine/motor compressor pump combustion/exhaust gas and associated piping 502 is subsequently utilized for energy production or energy regeneration as well as braking.

FIG. 4 displays the flow of the expanded exhaust gas through piping (tubing) 502, check valve 522 and entering the regenerative braking redirecting valve 529. The redirecting valve 529 allows flow to the tee fitting 530 and turbo-electric generator 525 or redirects the path through a check valve 524, tee fiting 526, check valve 605, the tee fitting 405 and finally into the combustion storage chamber 400 for energy storage and subsequent energy use. Should the combustion chamber 400 over-pressurize for any reason, including excessive combustion or excessive regenerative breaking, a safety valve 414 has been included in the embodiment allowing for an excessive pressure safety outlet through pipe 416, a check valve 418, tee fitting 438 and concludes by exhausting to the external ambient air.

As shown in FIG. 3, the gas flow exiting the adjustable exhaust tap 533 takes one of two directions. The first direction it takes is directly into the exhaust discharge piping (tubing) through a check valve 542 and three (3) tee fittings 544, 546 and 438. This is the path it takes, when heat generation is unnecessary or not desired. When heat generation is desired, expanded gas is directed through safety valve 546, heater core 531, check valve 548, tee 546 and exhausted to the atmosphere. The safety valve 546 normally allows flow to the heater core 531 when heat is in demand. In the event there is a blockage in the heater core 531 and excessive pressure builds, then the safety valve 546 allows flow through a second path through check valve 550, tee 544, and exhausted to the atmosphere.

Referring to FIG. 4, energy production by utilization of the engine exhaust flow (combustion gas) via combustion piping 502, or auxiliary engine bypass combustion gas via combustion piping 503 is primarily, but not limited to, via a turbine driven electric generator 525. During regenerative braking compressed air and/or combustion gas travels through piping 502 and is directed into pipe 503 by valve 529, flow through tees 405 and 526, high-pressure concentric regulator/reducer 560, pressure sensor gage 561, reduced operating pressure concentric regulator/reducer 562, reduced operating pressure—pressure sensor gage 563, check valve 564, tee fitting 565, control valve 566 and tee fitting 530 to the electric generator 525. The electric generator's output is in the form of voltage and current. During operation of the engine 500, the electric generator 525 can operate from expanded gas exhausted through pipe 502, valve 529, and tee 530. The electric energy recovered from expanded exhaust gas can be stored in battery form or utilized concurrently as it is generated. Other possible alternate applications for exhaust (combustion) gas energy utilization are also displayed in FIG. 3. One such alternate application is the generation of heat in the heater core/heat exchanger 531 which can be used to supply heat to a vehicle or use as another mechanism for the generation of compressed air for subsequent system combustion.

The primary feed path for the electric generator 525 is from the engine/motor compressor pneumatic/mechanical brake (pump) exhaust (combustion) gas piping (tubing) 502 discharge. The secondary (auxiliary) feed path for the electric generator 525 is the combustion gas piping (tubing) 608 directly from the combustion chamber, bypassing the engine/motor compressor pump. The tertiary (emergency) generator 525 feed path is compressed air via piping (tubing) 220, control valve 222, and check valve 224, directly from the compressed air cylinder bypassing both the combustion chamber and engine/motor compressor pump unit. The auxiliary and emergency feed paths for the electric generator 525 both also bypass the engine exhaust (combustion) gas/piping (tubing) 502 and energy regenerative breaking redirecting valve 529.

The optional energy regenerative braking feature is facilitated through an exhaust gas compression (and brake augmenting) brake control system activated by an exhaust control passage diversion (gas redirection) adjustable valve (safety valve possible) for the two stroke double-acting cycle engine 500. This exhaust gas brake system redirecting valve 529 can be closed in order to retard the rotational speed of the engine caused by engine exhaust (combustion gas) back pressure and break the vehicle. This back pressure is created by the motor acting as a compressor for braking purposes as well as recovering energy from the engine/motor compressor pump and stores it in a compressed gas state in the combustion chamber.

During regenerative braking, if the pressure produced is higher than the operating pressure of the combustion vessel 400, the pressurized air/combustion gassed from the exhaust pipe can be directly pumped into the combustion vessel. For example, if a typical gasoline engine having a 10:1 compression ratio is utilized, the maximum pressure obtained during regenerative braking will be 140 psi (14 lbs./in. atmospheric pressure times 10), which can be pumped into the combustion chamber when operating pressures of less than 140 are utilized. If the compression ratio is raised in the engine, such as increasing it to 20:1 compression ratio, the maximum pressure obtained during regenerative braking will be 240 psi, which can be pumped into the combustion chamber when operating pressures of less than 240 in the compression chamber are utilized.

If the operating pressure of the combustion vessel is greater than the maximum obtainable pressure during regenerative braking, the air/combustion gas can be pumped through optional tee 601 into an optional separate storage vessel 600 via pipe 602. The air/combustion gas in the separate storage vessel 600 can be pumped up to a pressure greater than the combustion vessel pressure using an optional compressor 603 operating off the engine 500 or electricity as desired. The higher pressure gas from compressor 603 can be supplied to the combustion chamber 400 via pipe 604. An optional check valve 705 is provided to prevent the higher pressure gas from flowing back into the optional storage vessel 600. If desired, the optional storage vessel 600 can be avoided and the air/combustion gas supplied directly to the optional compressor 603.

Any excess recovered, accumulated gas pressure-energy in the combustion/storage cylinder, for example, greater than the maximum allowable pressure, is vented into the exhaust system via a safety valve assembly 414 as a safety anti-lock and overpressure feature. Combustion and exhaust gas energy is used and recovered by the electrical generating turbine 525 system which generates and stores energy in an electrical state as well as for the platform's concurrent power generation and use.

This dual vessel design can be quickly integrated into existing engine/motor compressor pump designs with a few minor alterations including a new CAM/valve design and combination ignition system (electrostatic magneto 23 and dieseling effect) displayed in FIG. 3. This gas-energized engine system operates primarily as an open loop system with the ability to partially regenerate energy for subsequent use. The utilization of this design results in reduced emissions, lower pollution (emissions), slower combustion, lower heat production, higher combustion efficiency and lower rate of production of pollutants.

If desired the positive displacement engine described in U.S. Pat. No. 4,369,623 can replace the engine 500 and be powered by combustion of fuel and air from the high-pressure air and fuel vessels described herein. The complete disclosure of U.S. Pat. No. 4,369,623 is incorporated herein by reference.

If desired, the engine described in U.S. Pat. No. 3,885,387 can be modified to replace the engine 500 and be driven by the combustion gas from the combustion vessel 400 described herein. The complete disclosure of U.S. Pat. No. 3,885,387 is incorporated herein by reference.

If desired, the engine described in U.S. Pat. No. 4,292,804 can be modified to replace the engine 500 and be driven by the combustion gas from the combustion vessel 400 described herein. The complete disclosure of U.S. Pat. No. 4,292,804 is incorporated herein by reference.

If desired, the engine described in U.S. Pat. No. 4,102,130 can be modified to replace the engine 500 with be driven by the combustion gas from the combustion vessel 400 described herein. The complete disclosure of U.S. Pat. No. 4,102,130 is incorporated herein by reference.

Single High-Pressure Vessel Embodiment

Figure 5:
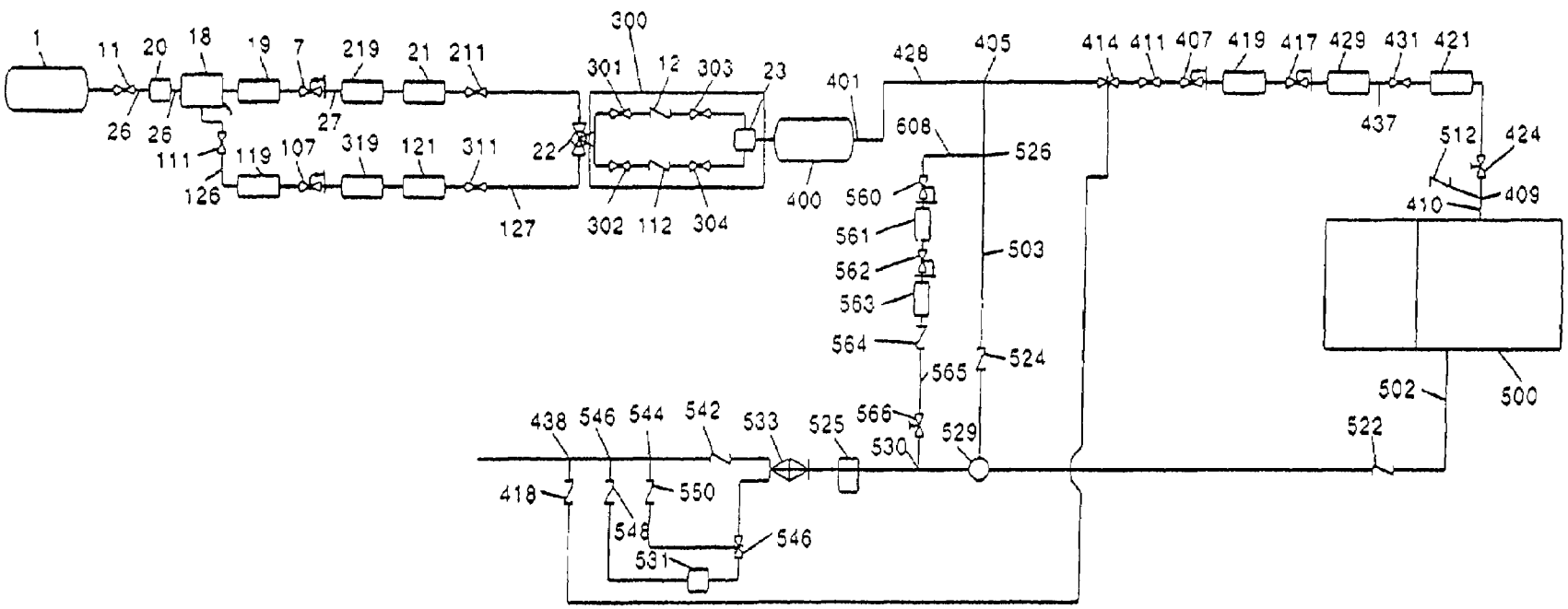
FIG. 5 illustrates a process and mechanical schematic diagram view showing a single-vessel embodiment of the present invention.

FIG. 5 is a schematic view illustrating a single-vessel embodiment of an external combustion engine and energy recovery apparatus based on the present invention.

Figure 6:
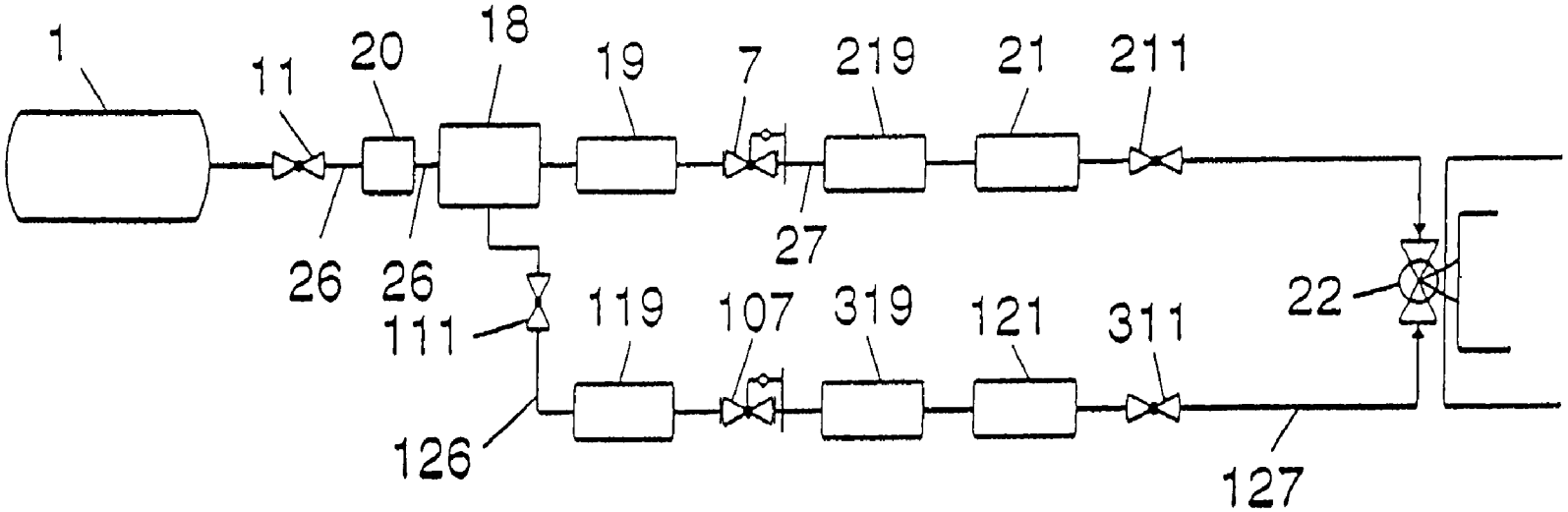
FIG. 6 illustrates a sectional process and mechanical schematic diagram view of FIG. 5 showing the fuel (compressed natural gas) high-pressure vessel with associated air compressor (pressure energy recovery device) supply piping (tubing) as well as associated apparatus flowing to the fuel/air mixing section.
Figure 7:
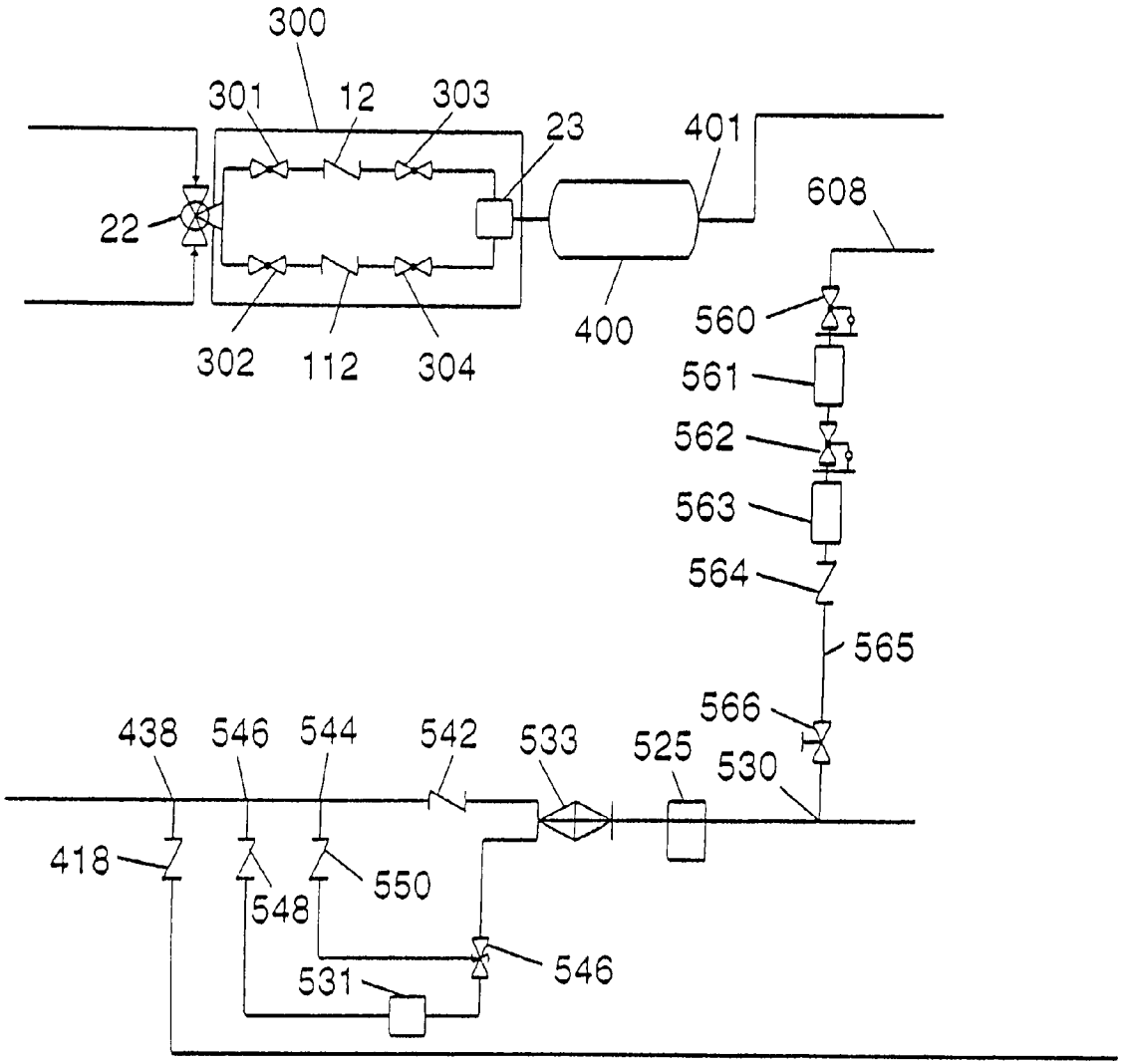
FIG. 7 illustrates a sectional process and mechanical schematic diagram view of FIG. 5 showing the ignition assembly, combustion/storage chamber, auxiliary exhaust piping (tubing) and exhaust piping (tubing) assembly.

This configuration for operation of the engine 500 employs single fuel storage and supply, high-pressure vessel 1. This high-pressure fuel vessel can be filament wound composite and aluminum, purely composite filament or the like, as described herein above in reference to the two-vessel embodiment. In FIG. 5, an engine having an adiabatic/isentropic and throttling characteristic is displayed using CNG. In FIG. 6 the CNG gas supply flows from the supply cylinder through a globe valve 11, high-pressure piping (tubing) 26, and a fill/pressure tap 20 to a CNG/air pressurized energy recovery/production compressor assembly 18.

One of the energy recovery/production systems in the single vessel engine configuration recovers and utilizes the energy of the highly pressurized CNG when it is partially depressurized prior to combustion. A second energy recovery/production system recovers and utilizes the energy of the exhaust/combustion gas, in the same manner as in the two-vessel embodiment. Energy production by utilization of the exhaust gas flow is primarily, but not limited to, via a turbine driven electric generator. The electric generator's output is in the form of voltage and current. The electric energy recovered from exhaust gas can be stored in battery or is utilized concurrently as it is generated. Other possible alternate applications for exhaust gas utilization is in the generation of heat as well as compressed air for combustion. The electric generator has two independent feed paths in the single vessel configuration including the exhaust gas feed.

Figure 8:
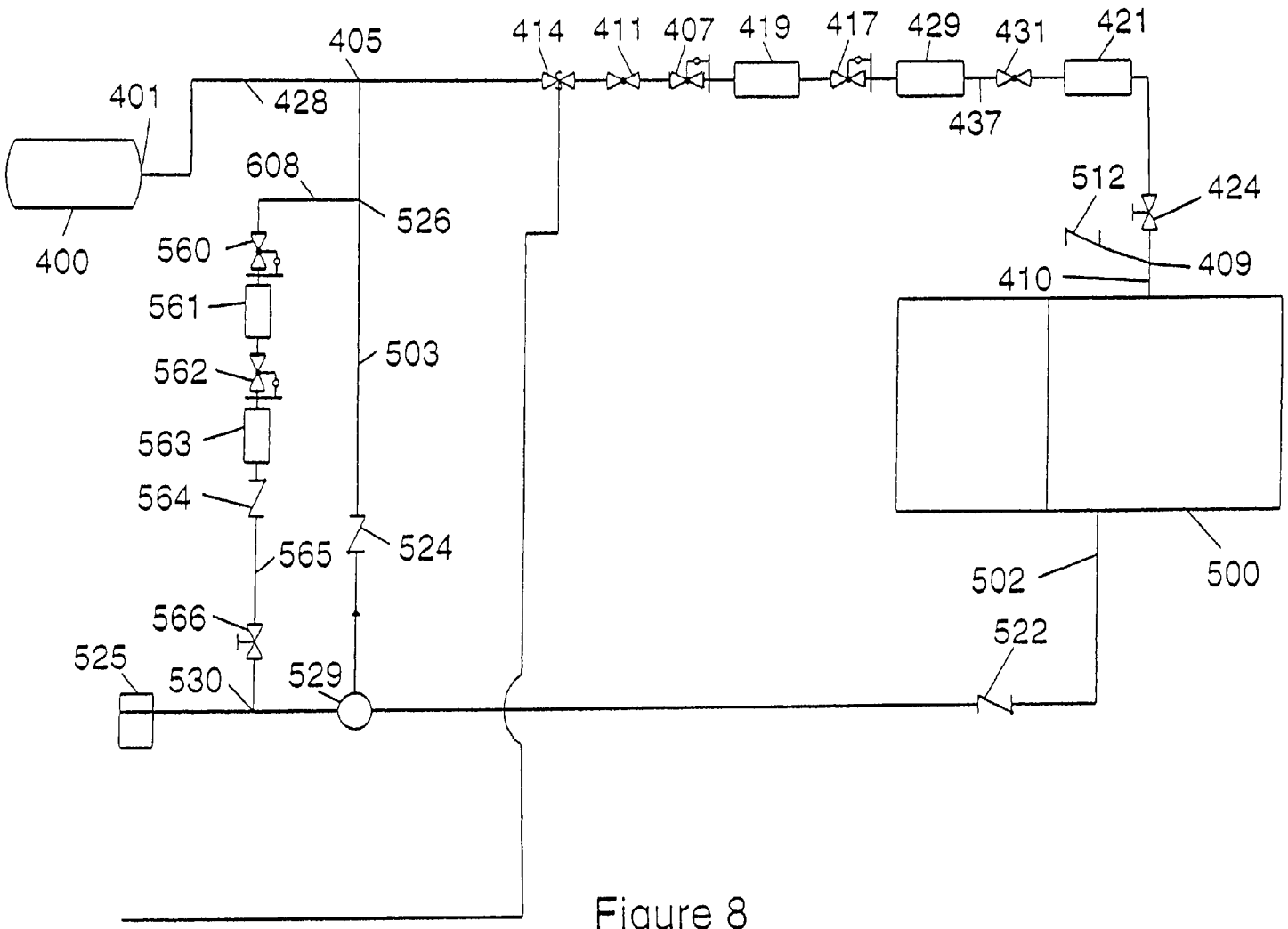
FIG. 8 illustrates a sectional process and mechanical schematic diagram view of FIG. 5 showing the auxiliary bypass piping (tubing), regenerative brake piping (tubing) and main engine/motor compressor pump assembly.

The flow of fuel from the energy recovery/production compressor assembly continues in the same manner as in the two-vessel embodiment. The compressed air leaving the compressor 18 flows through globe valve 11 and in a path similar to the compressed air in the two-vessel embodiment. The operation of the single-vessel embodiment is similar to the two-vessel embodiment and the reference numbers recited in FIGS. 6–9 operate in the same manner as described above in the two-vessel embodiment, with the following exceptions. The optional air storage vessel 600 and associated piping and valves have not been shown in FIG. 8 since the optional air storage vessel has already shown in FIG. 4. Furthermore, there are no pressurized air pipe 220 and valves 222 and 224 in the single-vessel embodiment.

If desired, any of the positive displacement engines described in U.S. Pat. Nos. 4,369,623; 3,885,387; 4,292,804; or 4,102,130 can be modified and utilized in place of the engine 500.

Electrical Generator Utilizing High Pressure Natural Gas Main

Figure 10:
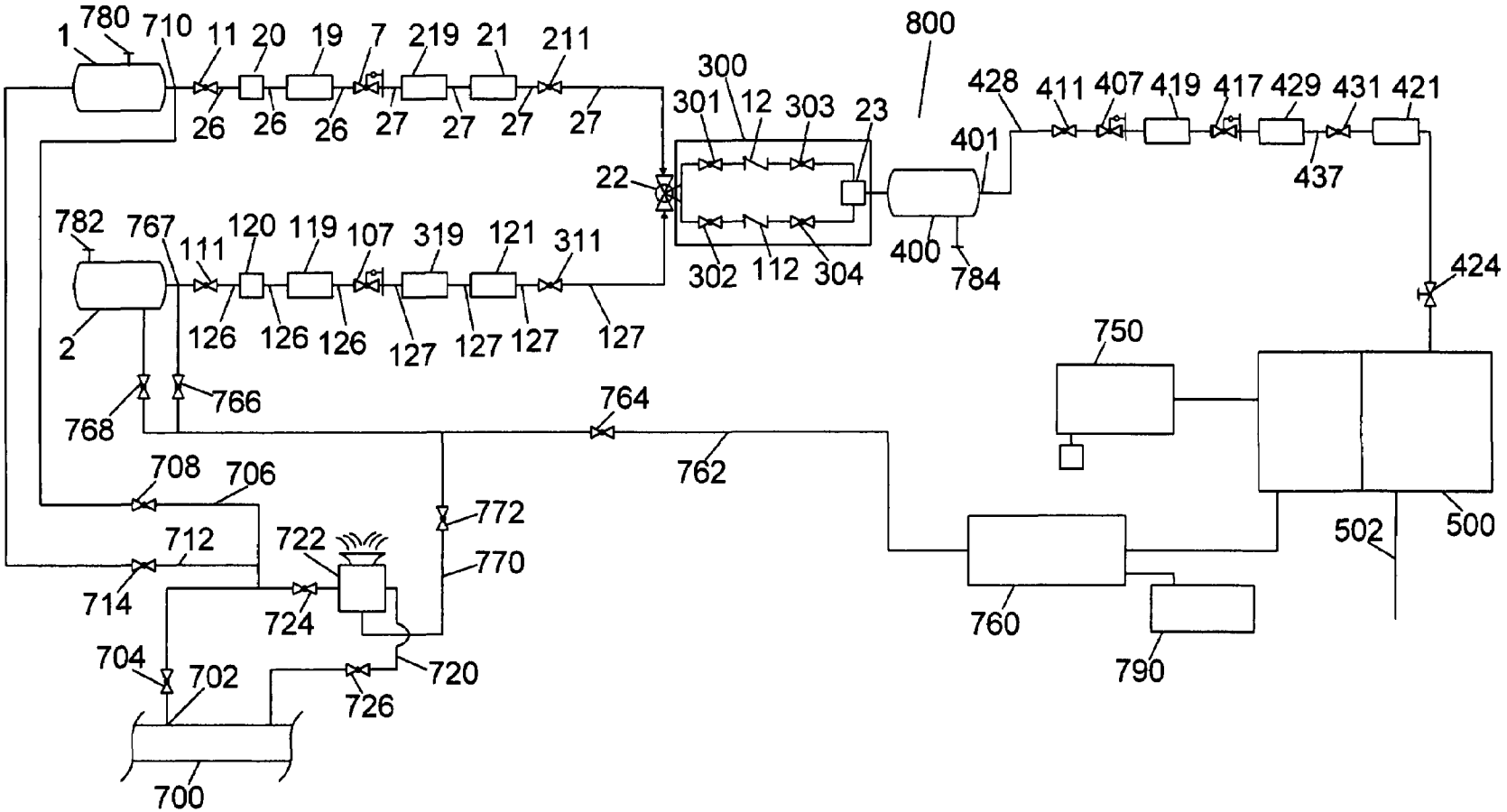
FIG. 10 illustrates an electrical generator.

As shown in FIG. 10, the electrical generator 800 utilizes an external combustion engine similar to that described herein above. The electrical generator comprises a high pressure main connector 702 for connecting to a high pressure natural gas main line 700 for supplying the combustion chamber 400 with fuel. The flow of high pressure natural gas from the main 702 can be regulated by valve 704, which controls at least one of the pressure or the amount of natural gas supplied to the combustion chamber. The natural gas can flow through line 706, valve 708 and tee 710 to supply the combustion chamber 400 and power the engine 500 as described herein above. Alternatively, the natural gas can flow through line 712, valve 714 into the high pressure gas vessel 1, and utilized to power the engine 500 as described herein above. In another alternative, the natural gas can flow through valve 726 and line 720 to an air compressor 722 that is powered by the compression energy of the natural gas to form compressed air and a lower pressure natural gas. The lower pressure natural gas can then flow through valve 724 to either of lines 706 or 712 as described above to supply the combustion chamber 400 with fuel. When the valves 726 and 724 are open to drive the compressor 722, the valve 704 should be closed.

The engine 500 operates in the same manner as described herein above to drive a generator 750 to produce and electrical charge. The engine 500 can also be utilized to power an air compressor 760 to supply compressed air through line 762, valves 764 and 766 and tee 767 to the combustion chamber 400. Alternatively, the compressed air can be supplied through valve 768 to fill the high pressure air vessel 2, and then utilized as described above. Compressed air can also be supplied to the vessel 2 or combustion chamber from the optional air compressor 722 through line 770 and valve 772 to either of valves 766 or 768. Instead of driving the air compressor 760 by the engine 500, the air compressor 760 can be driven by a separate motor 790, that can be any type of motor, such as electric, gas, natural gas, propane, steam, or diesel.

The vessels 1 and 2 preferably have overpressurization valves 780 and 782, respectively, to prevent ovepressurization of the vessels. The combustion chamber 400 also preferably contains an overpressurization valve 784 to prevent overpressurization. The safety valves 780, 782 and 784 can be of any suitable type, such as well-known blow valves.

If desired, the electrical generator 800 can utilize the apparatus described above and shown in FIGS. 1–9, such as the safety valve 414.

The electrical generator 800 utilizes the compression energy of the natural gas in the high pressure natural gas main to partially power the engine 500 in the same manner as the engines described herein above. In contrast, conventional electrical generators waste most of this compression energy. The engine 500 provides very quick power increases and decreases compared to conventional engines since the natural gas is precombusted in the combustion chamber 400. Since a pressurized gas is delivered to the engine 500, the engine 500 provides instant on for full power, whereas conventional engines have a significant lag time for full power since the gas must be combusted in the individual cylinders. During low electricity requirements the power output can be easily adjusted by regulating the flow of pressurized gas from the combustion chamber 400 to the engine 500, whereas conventional engines are significantly harder to fine tune the power output due to the erratic burning of fuel in the individual cylinders.

Operation

Double-Vessel Specific:

The two-vessel embodiment requires subsequent installation of commercial high-pressure air compressors and associated high-pressure vessels at existing and future compressed natural gas (CNG) service stations. Both the auxiliary and emergency electric generator engine features are available to be utilized.

Single-Vessel Specific:

The single-vessel embodiment takes advantage of existing and future CNG service stations and not require the subsequent installation of commercial air compressors and associated high-pressure vessels. It has a compressed fuel (CNG) high-pressure vessel feeding the ambient air energy recovery device and follow-on combustion/storage chamber, which feeds compressed combustion gases to the engine's positive displacement chambers. The auxiliary electric generator engine feature is available to be utilized.

Items Which are Common to Both Designs:

Both designs will take advantage of existing and future CNG service stations. Both have a minimal material change requirement (new compressors and air tanks for double vessel configuration) for service stations. The combustion/storage chamber portion of the system is always active when the system is operating ignition/activation mechanical or digital key switch is engaged. This differs from a motorized golf cart system, which starts a traditional internal combustion engine on demand.

The engine is "running" and delivers pressurized combustion (motive) gases on demand. The demand may be from one or more device(s) or apparatus simultaneously.

This system engine can be used as a drive system in vehicles as well as for energy generation as desired. Energy from the deceleration of the vehicle can be stored in a pressurized gas form for subsequent use. The system is designed primarily for retrofitting of existing vehicles and incorporation in new vehicles.

This design incorporates malfunction safety features such as but not limited to safety valves. This is a combustion engine/motor compressor pump, which has at a minimum combustion and storage features in an external combustion chamber that is separated from the positive displacement chambers of the engine.

Passages are provided between the combustion chamber and the positive displacement chambers of the engine with various valves along the flow path(s). The engine is a double-acting (power and compression) two stroke design. It has separate compressed fuel and oxidizing agent (oxygen in air) lines feeding the combustion/storage chamber which then subsequently feeds compressed combustion gas to engine's positive displacement chambers.

The intake and exhaust valves of the positive displacement chambers can be timed by the cam shaft controlled by the crank shaft rotated and powered by the introduction of compressed combustion gas to the engine's inlet. It is similar to a compressed air power plant which includes a piston disposed within a cylinder and connected to a drive shaft. The engine's piston is operated through reciprocating power (expansion) strokes and exhaust/compression strokes upon each rotation of the drive shaft. The compressed combustion gas is preferably introduced to the engine's positive displacement chambers at the initial portion (approximately top dead center) of the power stroke of the piston. As the compressed gas expands it forces the piston in a direction which increases the volume in the positive displacement chamber (expansion stroke) to form an expanded exhaust gas. The piston moves in a direction which decreases the volume in the positive displacement chamber. In this design, the simplified ignition assembly in the combustion chamber replaces the complicated conventional ignition system. Dieseling effect of fuel/air mixture is possible and may even be desirable in the combustion/storage vessel. An auxiliary option including but not limited to the gas exhaust heat exchanger and turbo electric generator is available from the same combustion chamber bypassing the engine. The engine has the ability to consume zero CNG fuel even though the engine is "operating" ("running") when propulsion or auxiliary power is not required, such as at a stop light, stop sign, coasting or traffic jam, which significantly reduces emissions. The stop does not consume CNG fuel since electric batteries can be utilized for control circuitry. A water condenser (as well as other auxiliary peripherals) can be introduced at later design stages to augment the engine design. An adjustable cam may be available at a later date which would allow conventional gasoline four stroke operation as well as the new design pressurizes two stroke operation (conventional ignition system required as well). Furthermore, the cam can be replaced with new technologies to control the timing of the intake and exhaust valves as desired. The engine uses include, but is not limited to, vehicles such as cars, trucks, aircraft, marine, camping, vans, submarine as well as basic combustion storage and electricity/heating/cooling auxiliary power.

The electrical generator 800 operates in the same manner, except that the fuel is supplied from a high pressure main line. For example, if natural gas is supplied to a vessel 1 and compressed air is supplied to a vessel 2, the electrical generator 800 operates in a manner like the dual vessel embodiment. If natural gas is supplied to vessel 1 and compressed air from compressor 722 is supplied to valve 766 (without using the vessel 2), then the electrical generator 800 operates in a manner like the single vessel embodiment. However, the electrical generator 800 can operate without vessels 1 and 2 by supplying the natural gas through valve 708 and compressed air through valve 766.

While the claimed invention has been described in detail and with reference to specific embodiments thereof, it will be apparent to one of ordinary skill in the art that various changes and modifications can be made to the claimed invention without departing from the spirit and scope thereof.

What is claimed is:

1. A method of making electricity and recovering the compression energy in an engine comprising:

supplying compressed natural gas from a high pressure main line to a combustion chamber;

supplying compressed air from a high pressure air vessel to the combustion chamber from the high-pressure air vessel;

burning said fuel and air in said combustion chamber to form a compressed combustion gas;

opening an intake valve and supplying said compressed combustion gas to a positive displacement chamber containing a reciprocating piston such that said compressed combustion gas expands forcing said piston in a direction that increases the volume of the positive displacement cylinder to form an expanded gas;

closing said intake valve and opening an exhaust valve and allowing the expanded gas to exit said displacement chamber while said piston is moving in a direction which decreases the volume of the positive displacement chamber to provide a exhaust gas and thereby produce rotational energy; and driving an electrical generator with said rotational energy to produce electricity.

2. A method according to claim 1, further comprising the step of driving an air compressor with the rotational energy to produce compressed air in said high pressure air vessel.

3. A method of making electricity and recovering the compression energy in an engine comprising:

supplying compressed natural gas from the high pressure main line to a high pressure gas vessel and supplying compressed natural gas from a high pressure gas vessel to a combustion chamber;

supplying compressed air from a high pressure air vessel to the combustion chamber from a high-pressure air vessel;

burning said fuel and air in said combustion chamber to form a compressed combustion gas;

opening an intake valve and supplying said compressed combustion gas to a positive displacement chamber containing a reciprocating piston such that said compressed combustion gas expands forcing said piston in a direction that increases the volume of the positive displacement cylinder to form an expanded gas;

closing said intake valve and opening an exhaust valve and allowing the expanded gas to exit said displacement chamber while said piston is moving in a direction which decreases the volume of the positive displacement chamber to provide a exhaust gas and thereby produce rotational energy; and driving an electrical generator with said rotational energy to produce electricity.

4. A method according to claim 3, further comprising filling the high-pressure fuel and air vessels to at least about 2000 pounds per square inch.

5. A method according to claim 3, further comprising filling the high-pressure fuel and air vessels to at least about 3000 pounds per square inch.

6. A method according to claim 3, further comprising filling the high-pressure fuel and air vessels to at least about 3500 pounds per square inch.

7. A method making electricity and recovering the compression energy in an engine comprising:

supplying compressed natural gas from a high pressure main line to a combustion chamber;

driving an air compressor with the compression energy of natural gas from said main line to produce compressed air in said high pressure air vessel;

supplying compressed air from a high pressure air vessel to the combustion chamber from a high-pressure air vessel;

burning said fuel and air in said combustion chamber to form a compressed combustion gas;

opening an intake valve and supplying said compressed combustion gas to a positive displacement chamber containing a reciprocating piston such that said compressed combustion gas expands forcing said piston in a direction that increases the volume of the positive displacement cylinder to form an expanded gas;

closing said intake valve and opening an exhaust valve and allowing the expanded gas to exit said displacement chamber while said piston is moving in a direction which decreases the volume of the positive displacement chamber to provide a exhaust gas and thereby produce rotational energy; and driving an electrical generator with said rotational energy to produce electricity.

8. A method according to claim 7, further comprising filling the high-pressure fuel and air vessels to at least about 2000 pounds per square inch.

9. A method according to claim 7, further comprising filling the high-pressure fuel and air vessels to at least about 3000 pounds per square inch.

10. A method according to claim 7, further comprising filling the high-pressure fuel and air vessels to at least about 3500 pounds per square inch.

* * * * *